US012729623B2

(12) United States Patent
Gunasekaran et al.

(10) Patent No.: US 12,729,623 B2
(45) Date of Patent: Sep. 8, 2026

(54) USING RADIO ISOTOPES AS A TRIGGERING ELEMENT IN DOWNHOLE APPLICATIONS

(71) Applicant: Halliburton Energy Services, Inc., Houston, TX (US)

(72) Inventors: Mohan Gunasekaran, Singapore (SG); Mathusan Mahendran, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 170 days.

(21) Appl. No.: 17/964,820

(22) Filed: Oct. 12, 2022

(65) Prior Publication Data

US 2024/0125230 A1 Apr. 18, 2024

(51) Int. Cl.
*E21B 47/12* (2012.01)
*E21B 23/06* (2006.01)

(52) U.S. Cl.
CPC ..... *E21B 47/138* (2020.05); *E21B 23/06* (2013.01)

(58) Field of Classification Search
CPC ..... E21B 47/138; E21B 23/06
See application file for complete search history.

(56) References Cited

U.S. PATENT DOCUMENTS

| | | | | |
|---|---|---|---|---|
| 6,349,766 | B1 * | 2/2002 | Bussear | E21B 23/0415 166/250.15 |
| 11,091,969 | B2 * | 8/2021 | Eggers | E21B 7/20 |
| 2003/0192695 | A1 | 10/2003 | Dillenbeck et al. | |
| 2006/0180754 | A1 | 8/2006 | Edwards et al. | |
| 2014/0202689 | A1 * | 7/2014 | Walton | E21B 43/26 166/99 |
| 2015/0315871 | A1 * | 11/2015 | Fripp | E21B 34/063 166/321 |
| 2016/0017704 | A1 | 1/2016 | Camwell et al. | |
| 2017/0183938 | A1 * | 6/2017 | Inglis | E21B 47/18 |
| 2017/0298720 | A1 | 10/2017 | Orban et al. | |
| 2021/0332655 | A1 | 10/2021 | Gunasekaran | |

OTHER PUBLICATIONS

International Search Report and Written Opinion for International Application No. PCT/US2022/048724 dated Jun. 28, 2023.

* cited by examiner

*Primary Examiner* — Nicole Coy
*Assistant Examiner* — Nicholas D Wlodarski
(74) *Attorney, Agent, or Firm* — Scott Richardson; C. Tumey Law Group PLLC

(57) ABSTRACT

Systems and methods of the present disclosure relate to control of a downhole tool via at least one radio isotope. The radio isotope(s) is pumped from the surface to contact an isotopic analyzer of the tool. The isotopic analyzer reads the isotope and directs the tool to perform a specific action(s) in the wellbore based on the type of isotope read by the analyzer.

14 Claims, 6 Drawing Sheets

USING RADIO ISOTOPES AS A TRIGGERING ELEMENT IN DOWNHOLE APPLICATIONS

BACKGROUND

In the oilfield, typical triggers used to control downhole tools during exploration or production operations, include differential pressure or pressure pulses, electrical signals, acoustic signals, and/or mechanical operations such as opening or closing a sleeve or knocking out a plug. The aforementioned triggers may require some form of intervention such as cables to transmit signals. In some open-hole applications, it may not be feasible to use any of the above-mentioned triggers.

BRIEF DESCRIPTION OF THE DRAWINGS

These drawings illustrate certain aspects of some examples of the present disclosure and should not be used to limit or define the disclosure.

DETAILED DESCRIPTION

The present disclosure relates to controlling downhole tools with radio isotopes such as for example, iridium, scandium, and/or antimony. Fluid including the particular isotope(s) may be circulated into a wellbore as a trigger. The fluid may include mud, water, or drilling fluid, for example. Each downhole operation performed by the tool is controlled by a particular isotope. That is, different isotopes may be employed for different downhole operations. The systems as described herein do not require mechanical intervention, nor signal transmission via cables. The circulating fluid contacts a downhole isotopic analyzer that is powered by a downhole battery.

The radioisotopes trigger initiation of an operation for mechanical and/or electrical downhole devices. Specifically, this may be used in a downhole application that involves pumping fluids from the surface into the wellbore. Different types of radio isotopes can be added along with the pumped fluid to trigger any specific operation in the downhole tool. An isotopic analyzer at the downhole tool seeks the trigger (i.e., radio isotopes from the surface) and initiates an operation in the tool, such as for example, opening/closing of a sleeve in a specific zone, or rupturing a disk to initiate any action.

Figure 1:
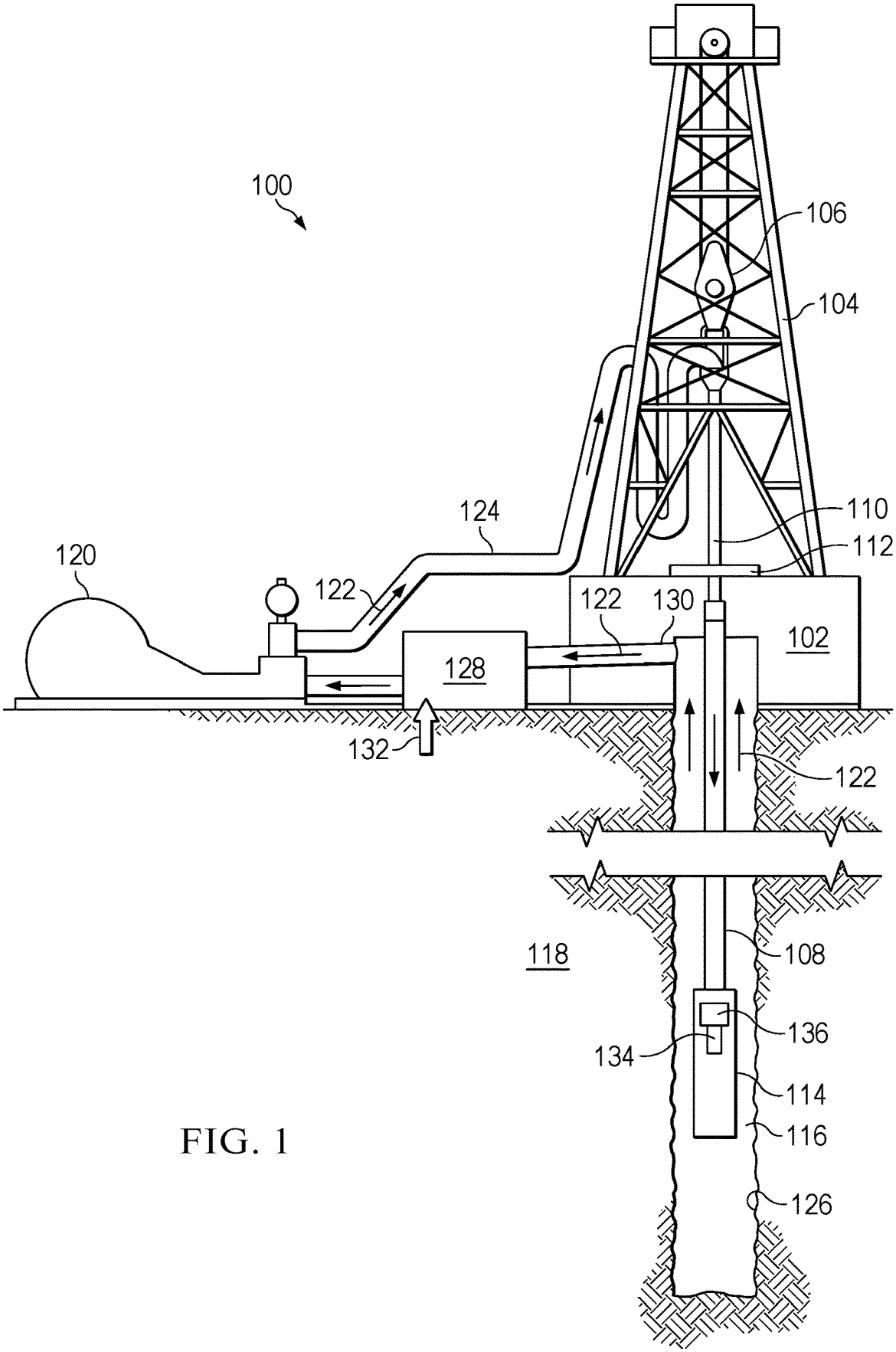
FIG. 1 illustrates an operating environment for using radio at least one radio isotope to control a tool in a wellbore, in accordance with examples of the present disclosure.

FIG. 1 generally depicts a land-based drilling assembly, those skilled in the art will readily recognize that the principles described herein are equally applicable to subsea drilling operations that employ floating or sea-based platforms and rigs, without departing from the scope of the disclosure.

The drilling assembly 100 may include a drilling platform 102 that supports a derrick 104 having a traveling block 106 for raising and lowering a tool string 108. The tool string 108 may include, but is not limited to pipe, cable, and coiled tubing. A kelly 110 supports the tool string 108 as it is lowered through a rotary table 112. A downhole tool 114 is attached to the tool string 108. The tool 114 may include frac plug, a bridge plug, a packer, or another type of wellbore zonal isolation device, for example, as it is being lowered to a predetermined depth within the wellbore 116 to perform a specific operation. In other examples, the tool 114 may include a logging tool (e.g., MWD, wireline).

A pump 120 (e.g., a mud pump) circulates a fluid (e.g., drilling fluid, mud) along flow path 122 through a feed pipe 124 and to the kelly 110, which conveys the fluid downhole through the interior of the tool string 108 and through one or more orifices in the tool 114. The fluid is then circulated along the flow path 122 back to the surface via an annulus 126 defined between the tool string 108 and the walls of the wellbore 116.

At the surface, the recirculated or spent drilling fluid exits the annulus 126 and may be conveyed to one or more mud pits 128 along the flow path 122 via an interconnecting flow line 130. While illustrated as being arranged at the outlet of the borehole 116 via the annulus 126, those skilled in the art will readily appreciate that the fluid processing area(s) 128 may be arranged at any other location in the drilling assembly 100 to facilitate its proper function, without departing from the scope of the disclosure.

The mud pit 128 may include radio isotopes 132 that may travel through the flow path 122 into the wellbore 116 to contact the tool 114. That is, desired isotopes may be added to the fluid for specific tool operations. Operations may include controlling (e.g., actuating/setting) packers, seals, and other downhole tools (e.g., firing transmitters or moving components or taking measurements), for example.

For example, each downhole operation performed by the tool is controlled by a particular isotope. The systems as described herein do not require mechanical intervention, nor signal transmission via cables. The circulating fluid contacts a downhole isotopic analyzer 134 that is powered by a downhole battery 136. The isotopic analyzer 134 seeks/reads the particular isotope and performs an operation based on identifying the isotope. For example, the tool 114 may be actuated (e.g., setting of a packer) based on the reading by the isotopic analyzer 134. The tool may include electrical and/or electromechanical systems for actuation.

The radioisotopes trigger initiation of an operation for mechanical and/or electrical downhole devices. Specifically, this may be used in a downhole application that involves pumping fluids from the surface into the wellbore. Different types of radio isotopes may be added along with the pumped fluid to trigger any specific operation in the downhole tool. The isotopic analyzer 134 at the downhole tool 114 seeks the trigger (i.e., radio isotopes from surface) and initiates an operation in the tool 114, such as for example, opening/closing of a valve or sleeve in a specific zone in the wellbore, or rupturing a disk.

Figure 2:
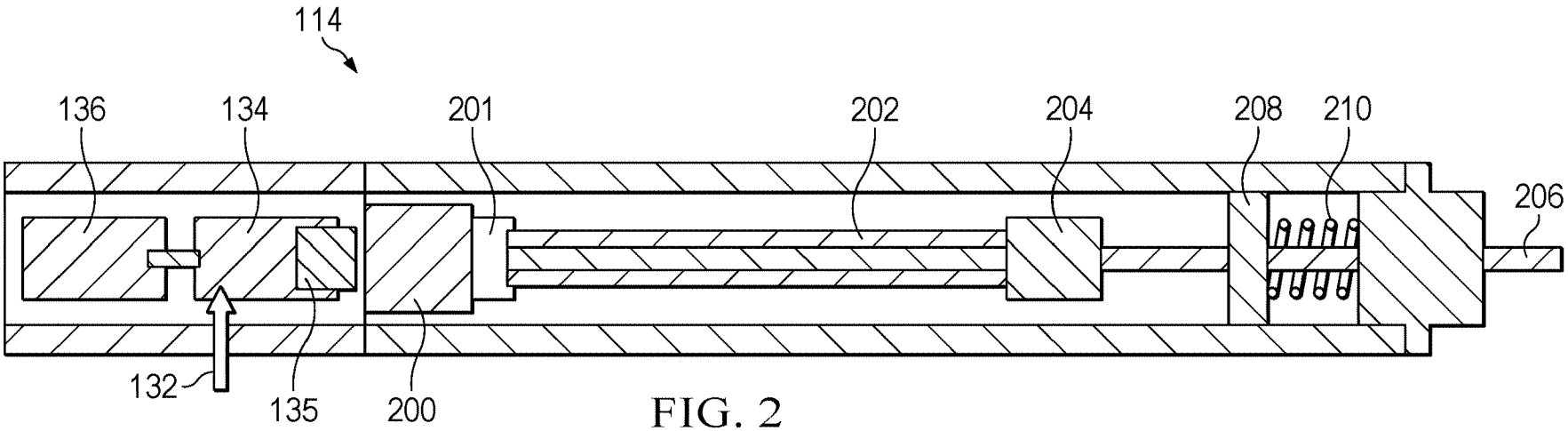
FIG. 2 illustrates a close-up view of the tool, in accordance with examples of the present disclosure.

FIG. 2 illustrates a close-up view of the tool 114, in accordance with examples of the present disclosure. The tool 114 includes the analyzer 134 and the battery 136. The analyzer 134 is in fluid communication with the circulating fluid. That is, the analyzer 134 is placed on an external portion of the tool 114 where the radio isotopes 137 are present in the annulus. Alternatively, the analyzer 134 is positioned internally within the tool 114 to read the isotopes. The analyzer 134 may include a computer 135 to control an electric motor 200 via gearbox 201 to move a sleeve 202.

The actuating components are powered by the battery 136. Some examples may further include a ball screw assembly 204, a rod 206, a piston 208, a spring 210, and a sub 212. Upon reading the specific isotope with the analyzer 134, the analyzer 134 directs the motor to spin to extend the sleeve 202 such that the ball screw assembly 204 moves the piston 208 to compress the spring 210 to move the sub 212 and the rod 206 to expand a sealing element, for example.

Figure 3:
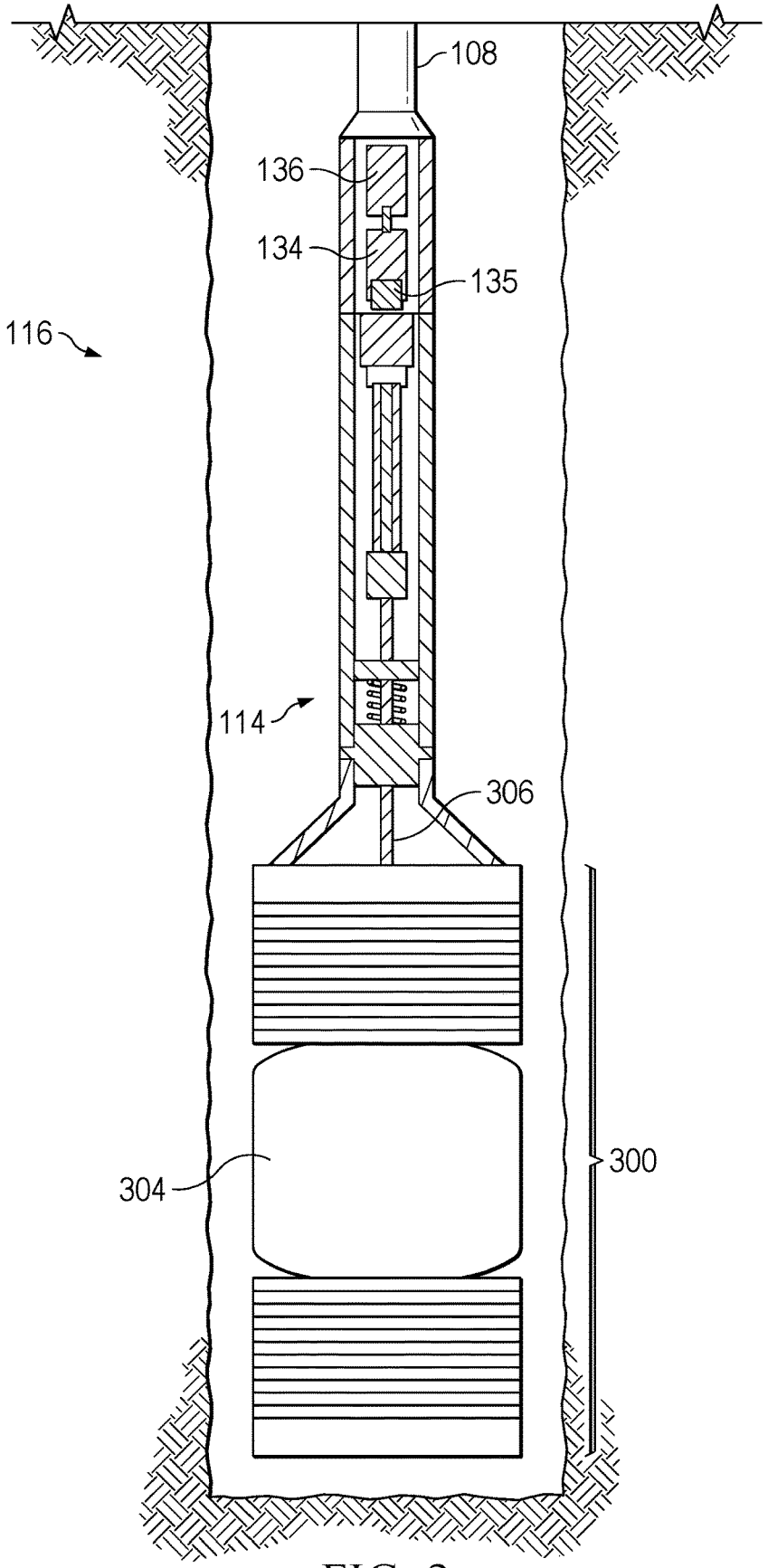
FIG. 3 illustrates lowering the tool, into the wellbore, in accordance with examples of the present disclosure.

FIG. 3 illustrates lowering the tool 114 including a seal (e.g., a packer 300), in accordance with examples of the present disclosure. The tool 114 is shown lowered via tool string 108, positioned and set in the wellbore 116. As shown, the tool 114 includes the packer 300 with an elastomeric/sealing element 304.

As discussed above, upon reading the specific isotope with the analyzer 134, the analyzer 134 directs the motor to spin to extend the sleeve such that the ball screw assembly moves the piston to compress the spring to move the sub and the rod 306 to expand the sealing element 304, for example to set the packer 300. The packer 300 is suspended and lowered into the wellbore 116 via the tool string 108. The packer 300, in the contracted position is lowered to a position in the wellbore 116 where it is desired to set the packer 300.

In other examples, the tool 114 includes other components such as a plug, cleanout tool, milling tool, and/or tools for introducing sand, cement, acids, and/or other chemicals into the wellbore 116. It should be noted that the tool 114 may be lowered or run into the well via electric line, slickline, coiled tubing, jointed pipe string or other conveyances as represented by the tool string 108.

Figure 4:
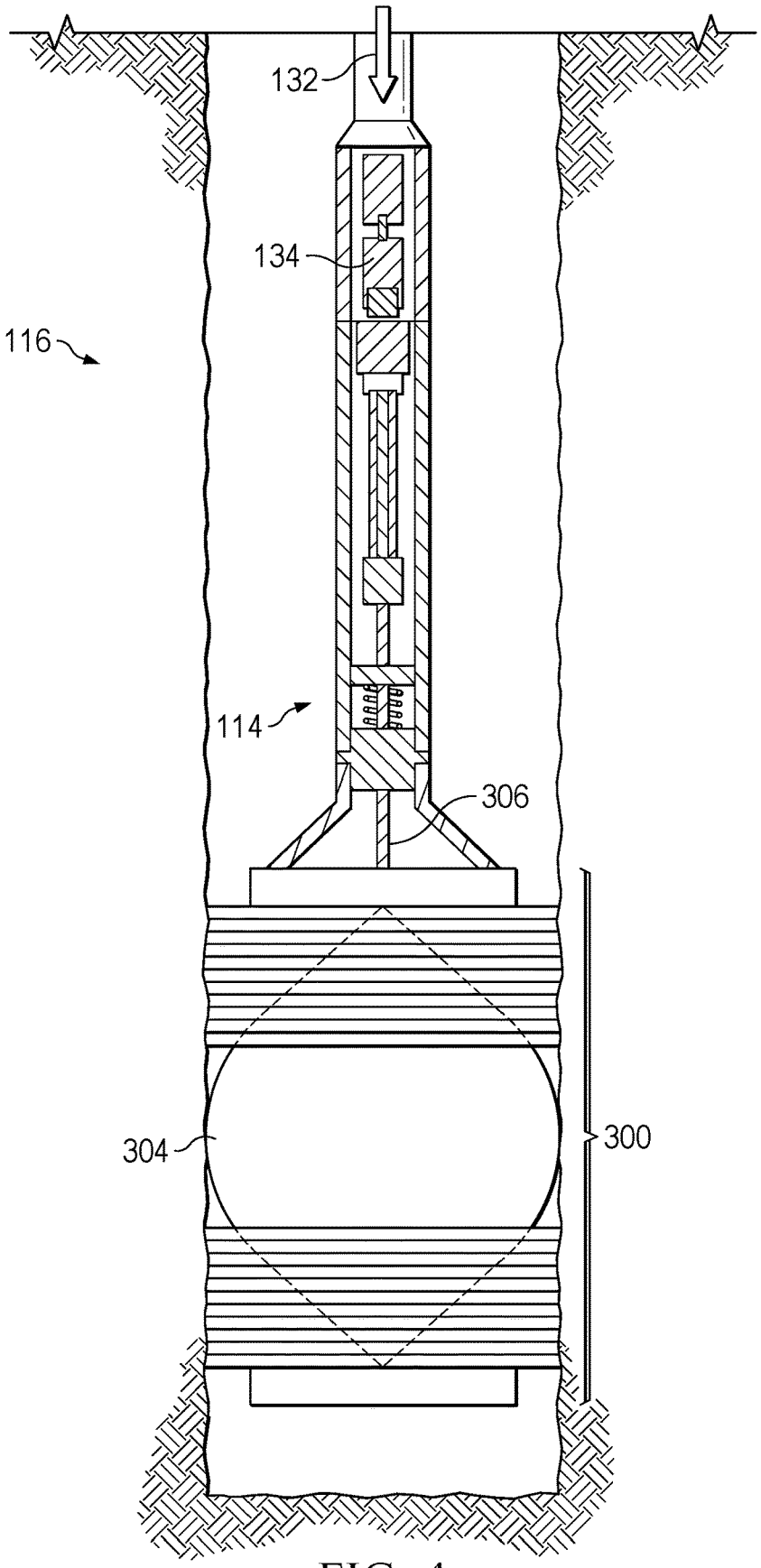
FIG. 4 illustrates performing an operation in the wellbore due to reading of the at least one radio isotope, in accordance with examples of the present disclosure.

FIG. 4 illustrates setting the packer 300 in the wellbore 116, in accordance with examples of the present disclosure. Upon contacting the radio isotope 132 pumped from the surface, the analyzer 134 reads the specific radio isotope 132 for setting the packer 300 in the wellbore 116 and subsequently the packer 300 is set. For example, the rod 306 engages the packer 300 and initiates expansion movement of the elastomeric element 304. The elastomeric element 304 seals the wellbore 116. The tool 114 may disconnect from the packer 300 for removal out of the wellbore 116.

Figure 5:
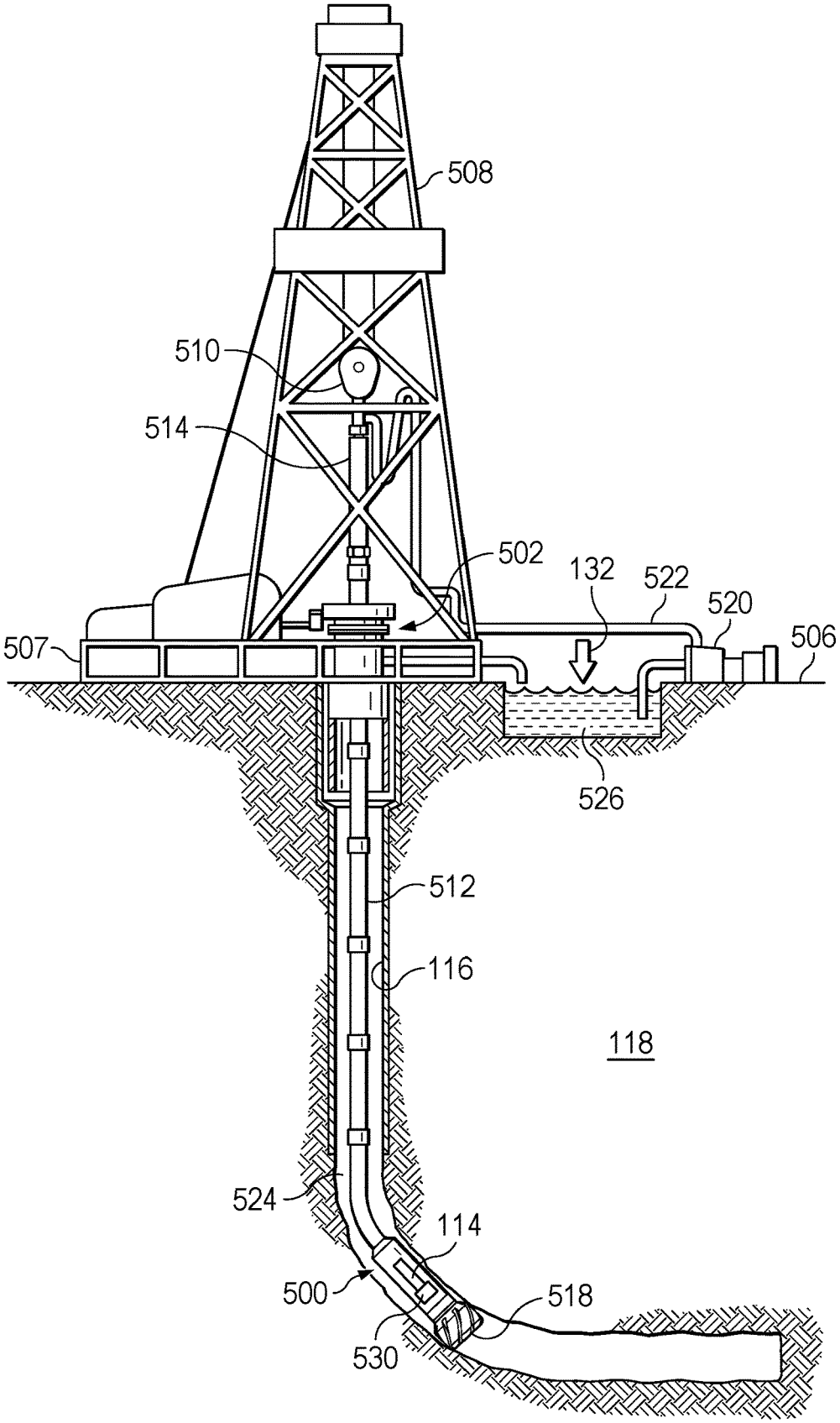
FIG. 5 illustrates the tool included in a drilling system, in accordance with examples of the present disclosure.

FIG. 5 illustrates the tool 114 included in a drilling system, in accordance with examples of the present disclosure. It should be noted that while FIG. 5 generally depicts a land-based operation, those skilled in the art may recognize that the principles described herein are equally applicable to subsea operations that employ floating or sea-based platforms and rigs, without departing from the scope of the disclosure. In this configuration, the tool 114 may be used to actuate an electrical and/or mechanical component (e.g., transmitter/receiver, steering pad, valve, sleeve) of a tool 500 (e.g., logging tool, mud motor). The tool 114 may be disposed on the outside of the tool 500 or on the inside of the tool 500.

As illustrated, the wellbore 116 may extend from a wellhead 502 into the subterranean formation 118 from a surface 506. The wellbore 116 may include horizontal, vertical, slanted, curved, and other types of borehole geometries and orientations. A drilling platform 507 may support a derrick 508 having a traveling block 510 for raising and lowering a drill string 512. The drill string 512 may include, but is not limited to, drill pipe and coiled tubing, as generally known to those skilled in the art. A top drive or kelly 514 may support the drill string 512 as it may be lowered into the wellbore 116.

A drill bit 518 may be attached to the distal end of drill string 512 and may be driven either by a downhole motor and/or via rotation of drill string 512 from the surface 507. Without limitation, the drill bit 518 may include roller cone bits, PDC bits, natural diamond bits, any hole openers, reamers, coring bits, and the like. As the drill bit 518 rotates, it may create and extend wellbore 116 that penetrates the subterranean formation 118.

A pump 520 may circulate drilling fluid through a feed pipe 522 to the kelly 514, downhole through the interior of the drill string 512, through orifices in the drill bit 518, back to the surface 507 via an annulus 524 surrounding the drill string 512, and into a retention pit 526. The radio isotope(s) 132 may be added to the pit 526 for pumping into the wellbore 116. Upon reading the specific isotope with the tool 114, the tool 114 actuates a mechanical and/or electrical component 530 of the tool 500. Different isotopes may correspond with different downhole operations. For example, one isotope may close a valve, and another isotope may open the valve. In some examples, at least one radio isotope is pumped into the wellbore after drilling of the wellbore.

Figure 6:
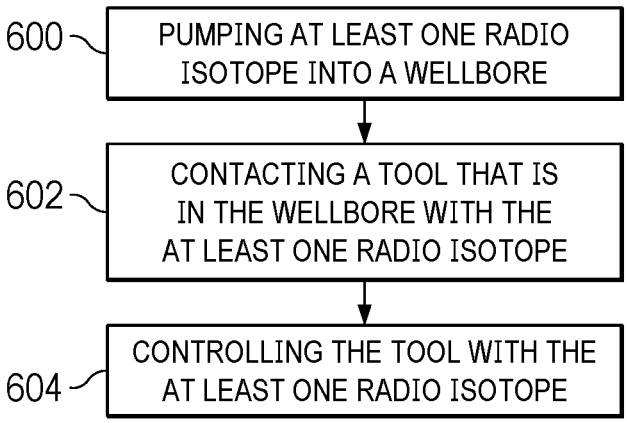
FIG. 6 illustrates an operative sequence for controlling a tool in a wellbore with radio isotopes, in accordance with examples of the present disclosure.

FIG. 6 illustrates an operative sequence for controlling a tool in a wellbore with radio isotopes, in accordance with examples of the present disclosure. At step 600, at least one radio isotope is pumped into the wellbore (e.g., see FIG. 1). Non-limiting examples of the radio isotopes may include iridium, scandium, and/or antimony. The fluid including the particular isotope(s) may be circulated/pumped into the wellbore as a trigger. The fluid may include mud, water, or drilling fluid, for example.

At step 602, the at least one radio isotope contacts the tool. An isotope analyzer seeks/reads the particular isotope that is being pumped into the wellbore. The systems as described herein do not require mechanical intervention, nor signal transmission via cables. For example, the isotope analyzer may be powered by a downhole battery (e.g., see FIG. 2).

At step 604, the tool performs an operation based on identifying the isotope. For example, the tool may be actuated (e.g., setting of a packer) based on the reading by the isotopic analyzer (see FIG. 3). The tool may include electrical and/or electromechanical systems for actuation. For example, each downhole operation performed by the tool is controlled by the particular isotope.

The circulating fluid contacts a downhole isotopic analyzer that is powered by a downhole battery. The tool may be used in various downhole environments such as zonal isolation systems shown on FIG. 1 (e.g., packer) or in a drilling system (e.g., FIG. 5). That is, the radio isotope may be utilized to control various operations of numerous downhole tools in different environments.

Accordingly, the systems and methods of the present disclosure allow controlling of a downhole tool via at least one radio isotope. The radio isotope(s) is pumped from the surface to contact an isotopic analyzer of the tool. The isotopic analyzer reads the isotope and directs the tool to perform a specific action(s) based on the type of isotope read by the analyzer. The systems and methods may include any of the various features disclosed herein, including one or more of the following statements.

Statement 1. A method comprising: pumping at least one radio isotope into a wellbore; contacting a tool with the at least one radio isotope; and controlling the tool with the at least one radio isotope.

Statement 2. The method of the statement 1, wherein the contacting occurs at an isotopic analyzer.

Statement 3. The method of the statement 1 or the statement 2, further comprising powering the isotopic analyzer with a battery.

Statement 4. The method of any one of the statements 1-3, wherein the controlling includes actuating a component of the tool.

Statement 5. The method of any one of the statements 1-4, wherein the controlling includes setting a packer in the wellbore.

Statement 6. The method of any one of the statements 1-5, wherein the controlling includes moving a sleeve.

Statement 7. The method of any one of the statements 1-6, wherein the controlling includes initiating an operation with the tool.

Statement 8. A method comprising: contacting an isotopic analyzer with at least one radio isotope, wherein the at least one radio isotope is disposed in a wellbore; and performing an operation with a tool that is positioned in the wellbore based on a reading of the at least one radio isotope with the isotopic analyzer.

Statement 9. The method of the statement 8, wherein the isotopic analyzer is powered by a battery that is disposed in the wellbore.

Statement 10. The method of the statement 8 or 9, wherein the at least one radio isotope is pumped into the wellbore.

Statement 11. The method of any one of the statements 8-10, wherein the at least one radio isotope is pumped into the wellbore after drilling of the wellbore.

Statement 12. The method of any one of the statements 8-11, wherein performing the operation in the wellbore includes actuating a component of the tool.

Statement 13. The method of any one of the statements 8-12, wherein performing the operation in the wellbore includes setting a packer in the wellbore.

Statement 14. The method of any one of the statements 8-13, wherein performing the operation in the wellbore includes moving a sleeve in the wellbore.

Statement 15. A system comprising: at least one radio isotope; a tool including: an isotopic analyzer; and a battery to power the tool, the tool operable to perform an operation based on a reading of the at least one radio isotope.

Statement 16. The system of any one of the statements 13-15, wherein the tool is positioned in a wellbore.

Statement 17. The system of any one of the statements 13-16, wherein the tool further includes a sleeve operable to move based on the reading of the at least one radio isotope.

Statement 18. The system of any one of the statements 13-17, wherein the tool further includes a packer, the tool operable to set the packer based on the reading of the at least one radio isotope.

Statement 19. The system of any one of the statements 13-18, wherein the tool further includes a component, the component operable to move based on the reading of the at least one radio isotope.

Statement 20. The system of any one of the statements 13-19, further including a pump at a surface of a wellbore, the pump operable to circulate the at least one radio isotope into the wellbore, wherein the tool is positioned in the wellbore.

Although the present disclosure and its advantages have been described in detail, it should be understood that various changes, substitutions, and alterations may be made herein without departing from the spirit and scope of the disclosure as defined by the appended claims. The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the elements that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A method comprising:

pumping at least one type of radio isotope into a wellbore;

contacting a tool with the at least one type of radio isotope at a downhole isotopic analyzer;

reading the at least one type of radio isotope with a downhole isotopic analyzer of the tool to determine a specific type of the at least one type of radio isotope; and triggering operation of the tool in response to identification of the specific type of the at least one radio isotope.

2. The method of claim 1, wherein the triggering actuates the tool to set a packer.

3. The method of claim 2, further comprising powering the isotopic analyzer with a battery.

4. The method of claim 3, further comprising pumping a different type of radio isotope into the wellbore.

5. The method of claim 1, wherein the triggering includes moving a sleeve.

6. The method of claim 4, further comprising triggering a different operation of the tool in response to identification of the different type of radio isotope.

7. The method of claim 1 wherein the specific type of the at least one radio isotope directs the tool to rupture a disc.

8. The method of claim 1 wherein the specific type of the at least one radio isotope directs the tool to open a sleeve within a specific zone.

9. A system comprising:

a first type of radio isotope;

a second type of radio isotope;

a packer;

a tool including:

an isotopic analyzer; and a battery to power the tool, the tool operable to set the packer based on a reading of the first type of radio isotope and close a valve based on a reading of the second type of radio isotope.

10. The system of claim 9, further comprising a third type of radio isotope wherein the tool is further operable to rupture a disc on a reading of the third type of radio isotope.

11. The system of claim 9, wherein the tool further includes a sleeve operable to move based on the reading of the at least one radio isotope.

12. The system of claim 9, wherein the tool is operable to move a rod located outside the tool to expand the packer based on the reading of the at least one radio isotope.

13. The system of claim 9, wherein the tool further includes a component, the component operable to move based on the reading of the at least one radio isotope.

14. The system of claim 9, further including a pump at a surface of a wellbore, the pump operable to circulate the at least one radio isotope into the wellbore, wherein the tool is positioned in the wellbore.

* * * * *